United States Patent [19]

Lindquist et al.

[11] Patent Number: 5,003,290

[45] Date of Patent: Mar. 26, 1991

[54] INTEGRATED ALARM AND ACCESS CONTROL SYSTEM

[76] Inventors: Jonathan B. Lindquist, 3400 W. Park, No. 1131, Plano, Tex. 75075; Granger W. Smith, IV, Rte. 1, Box 173, Melissa, Tex. 75071

[21] Appl. No.: 463,393

[22] Filed: Jan. 11, 1990

[51] Int. Cl.[5] ..... G08B 13/08

[52] U.S. Cl. ..... 340/545; 49/14; 49/506; 340/506; 340/528

[58] Field of Search ..... 340/545, 541, 542, 506, 340/528, 529; 49/14, 506

[56] References Cited

U.S. PATENT DOCUMENTS 4,283,710 8/1981 Genest et al. ..... 340/506

4,375,637 3/1983 Desjardins ..... 340/506

4,803,482 2/1989 Verslycken ..... 340/541

*Primary Examiner*—Glen R. Swann, III

*Attorney, Agent, or Firm*—Timmons & Kelly

[57] ABSTRACT

An integrated alarm and access control system includes an access control package, an intrusion detection package and an interface unit. A position sensor determines if a door is open or closed and an electrically activated locking device locks the door in its closed position. A supervisory circuit provides line security. A door position relay and a first timer prevent an alarm signal from the supervisory circuit if the door is open and the egress device is actuated for a time period. A door control relay activates locking devices and a second timer responds to the door control relay, the egress device and the door position relay to give a prealarm signal. Fail-safe and fail-secure circuits are included.

7 Claims, 2 Drawing Sheets

INTEGRATED ALARM AND ACCESS CONTROL SYSTEM

TECHNICAL FIELD

The present invention relates generally to intrusion alarm systems and access control systems and, in particular, to a system for integrating intrusion alert and access control systems.

BACKGROUND ART

In the past, intrusion alarm systems and fire alarm systems were installed separately from access control systems. Since the systems were normally incompatible, each system would require its own position sensors for determining if doors were opened or closed. When attempts were made to integrate the various systems, installation and repair required highly trained technicians to trace out problems to a single faulty component.

DISCLOSURE OF INVENTION

An integrated alarm and access control system according to the present invention includes a standard access control package, an intrusion detection package for an alarm system and an interface unit operatively connected to both the access control package and the intrusion detection package. A position sensor must be installed for each door along with a locking device for locking a door in its closed position. Some preferred systems have both fail-safe locking devices which unlock doors when power is interrupted and fail-secure locking devices which unlock doors when power is applied. Fail-safe locking devices are used on doors which need to be unlocked in case there is a power failure so that employees could leave the building. The interface unit transmits status information from the position sensors to either the access control package or the intrusion detection package or both and can control the locking devices responsive to the access control package. Some doors can also be equipped with egress devices which allow people to leave the building or a secure area but not to enter without security clearance.

In one arrangement, an alarm panel is installed at a guard station to provide certain alarm information visually to the guards at that station. A supervisory circuit with an end of line (EOL) resistor in series with the door position sensor monitors line security. If the circuit is opened, an "alarm" or "unsecure condition" report is generated by the alarm panel. If the circuit is shorted, a "trouble" signal is generated by the alarm panel.

The interface unit also includes both a door position relay which is operatively connected to the position sensor and a door control relay for operating a locking device. First and second timers allow time for egress and a prealarm warning if a door is left open for too long.

These and other objects, advantages and features of this invention will be apparent from the following description taken with reference to the accompanying drawing, wherein is shown the preferred embodiment of the invention.

BEST MODE FOR CARRYING OUT THE INVENTION

Figure 1:
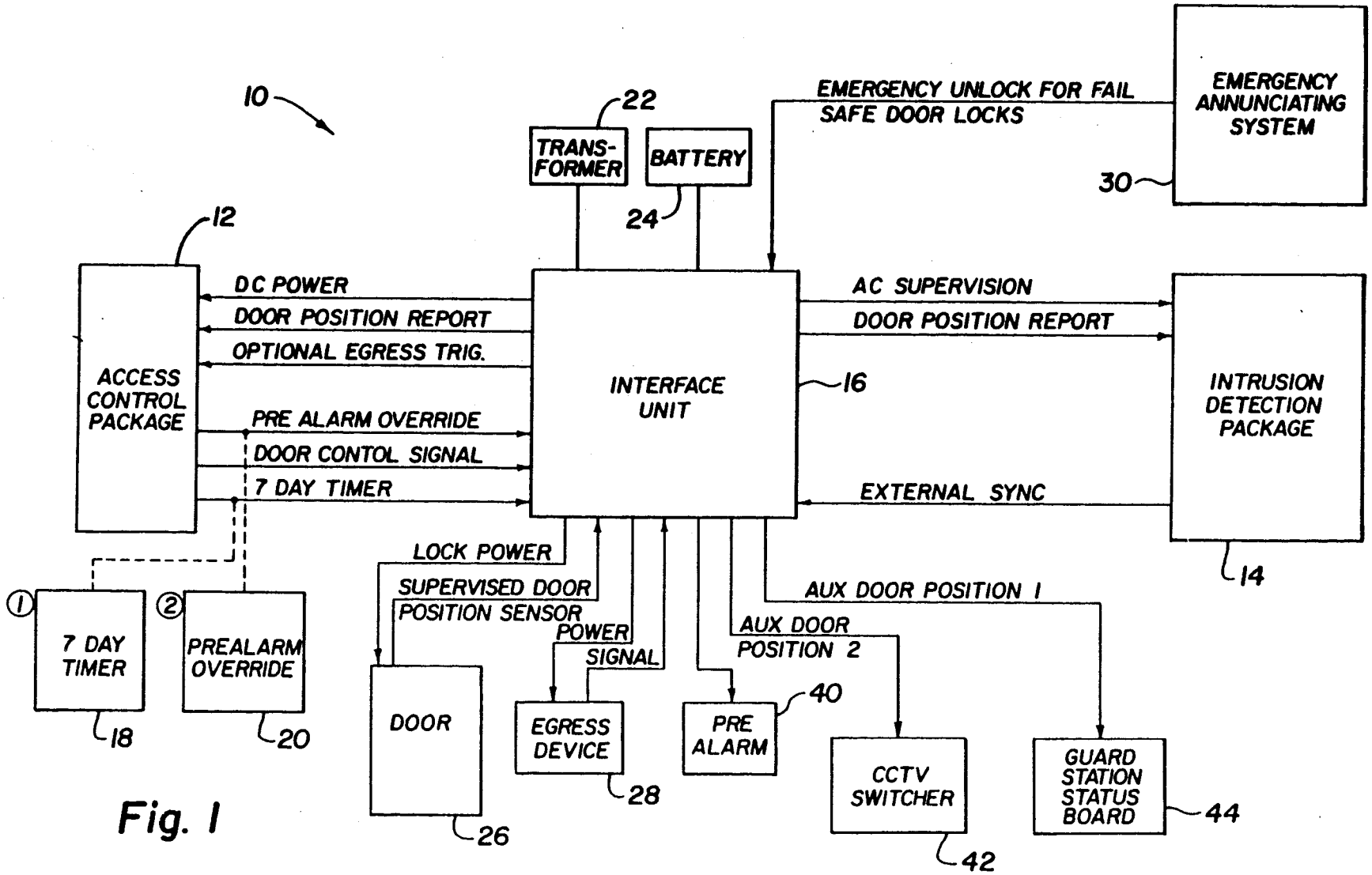
FIG. 1, a block diagram representation of an integrated alarm and access control system according to the present invention.

Referring now to the drawing, and in particular to FIG. 1, an integrated alarm and control system according to the present invention is referred to generally by reference numeral 10. System 10 includes an access control package 12, an intrusion detection package 14 and an interface unit 16 operatively connected to the access control package and the intrusion detection package. A seven day timer 18 and a prealarm override circuit 20 can be separate components or part of access control package 12. Interface unit 16 is normally powered from line power through transformer 22 or, in case of a power failure, directly from battery 24. Interface unit 16 monitors the position of a door 26, an egress device 28 and an emergency annunciating system 30.

Figure 2:
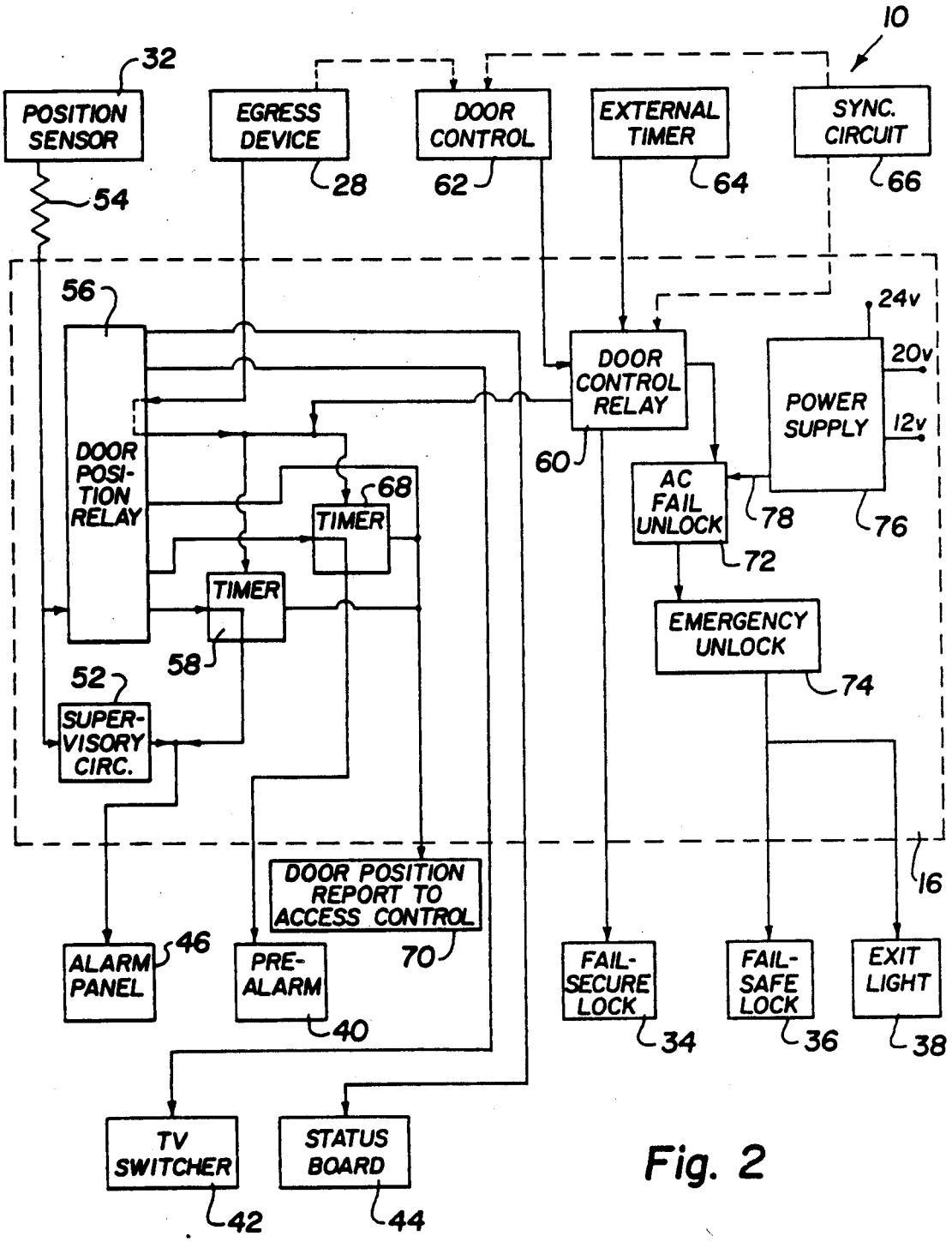
FIG. 2 is a diagrammatic representation of an integrated a and access control system according to the present invention.

Referring now also to FIG. 2, interface unit 16 monitors the position of door 26 by use of a door position sensor 32. Interface unit 16 also controls fail-secure locking device 34 and fail-safe locking device 36 as well as exit light 38, prealarm indicator 40, closed circuit television switcher 42 and guard station status board 44 which would normally include alarm panel 46.

Interface unit 16 includes a supervisory circuit 52 operatively connected to position sensor 32 for providing line security. A typical arrangement for supervisory circuit 52 is to include a resistor 54 connected in series with door position sensor 32. Since resistor 54 is physically positioned near door position sensor 32, and it constantly provides a voltage of some magnitude for supervisory circuit 52, an opening or short in the line will change that voltage, and the change in voltage can be detected by the supervisory circuit. Interface unit 16 also includes a door position relay 56 and a first timer 58 for determining a first predetermined time period, responsive to both the door position relay and the egress device. The first timer inhibits a response by an alarm panel 46 to supervisory circuit 52 if both door 26 is open and egress device 28 is actuated, until the first predetermined time period has elapsed. First timer 58 is normally an adjustable timer, although once it has been adjusted, the time period is predetermined for that particular adjustment.

In one arrangement, interface unit 16 also includes a door control relay 60 for operating fail-secure locking device 34 and fail-safe locking device 36 as well as exit light 38. Door control relay 60 is responsive to access control package 12 and, in particular, to door control 62 and in some arrangements also to an optional external timer 64 and an optional external synchronizing circuit 66. A second timer 68 within interface unit 16 determines a second predetermined time period, responsive to door control relay 60, egress device 28 and door position relay 56. Prealarm indicator 40 gives a warning of a pending alarm condition responsive to the second timer when door 26 is open and the second predetermined time period has elapsed. In one arrangement, access control package 12 also includes a door position report circuit 70 responsive to door position relay 56, first timer 58 and second timer 68 for indicating to access control package 12 when the door is open and either the first time period or the second time period has elapsed.

In one preferred arrangement, interface unit 16 also includes an AC fail unlock circuit 72 operatively connected to fail-safe locking device 36 for unlocking the fail-safe locking device in the event of a power failure, and an emergency unlock circuit 74 operatively connected to fail-safe locking device 36 for unlocking the fail-safe locking device in the event of loss of signal from system 30.

In a preferred arrangement, interface unit 16 is manufactured on a printed circuit board, and has an onboard power supply 76 which supplies two regulated voltages, 12 volts and 20 volts, as well as an unregulated 24 volts. Power supply 76 will normally have an alarm output 78 to indicate that AC power has failed. In addition, interface unit 16 will normally incorporate a current limiting charging system and a low voltage protection circuit allowing the use of battery 24 to provide power in the event of a building power failure. A report is provided immediately to guard station 44 upon loss of line power.

Interface unit 16, in a preferred arrangement, provides four outputs relative to position sensor 32, allowing the use of one door position sensor for four different functions: a report to an alarm system, a report to an access control system, a report to a guard desk door position indicator board, and a report to a closed circuit television switcher. The system also incorporates a voltage sensing circuit, supervisory circuit 52, to maintain the integrity of the line supervision feature incorporated in many currently available burglar alarm systems. This system provides a dual, independently adjustable output timer which, upon a valid entry or egress, shorts across the burglar alarm output, effectively hiding the open door from the burglar alarm system for a predetermined period of time and starts the countdown for a prealarm indicator, thus reducing the number of false alarms. The report to the access control system is also tied into these timers to allow a "door open" report to be selectively generated only upon an actual alarm or also upon a prealarm or whenever the door is open, the first two options saving a tremendous amount of hard copy from an access control printer.

The system also provides the ability to coordinate several doors for automatic unlock or automatic override of the access control system, for instance in a situation where an end user wishes to unlock certain doors when the security system is disarmed and wants to disable the access control system when the security system is armed.

The system will accommodate either fail-safe or fail-secure locking devices and allows for fail-safe devices to be unlocked upon loss of signal from an external force such as a master unlock or a fire alarm indicator.

Finally, since the entire interface is contained on a single printed circuit board, and conceivably the entire system except for such devices as sensors and locking devices is contained on a single printed circuit board, time consumed in installation and service is greatly reduced. Instead of having to send a highly trained technician out to trace out a problem, a service manager might send a junior technician to replace the entire system in a fraction of the time and at a fraction of the cost. The faulty system can simply be returned to the factory or shop for maintenance and repair.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing of the scope thereof, it is to be understood that all matters herein set forth or shown in the figures of the accompanying drawing are to be interpreted as a illustrative and not in a limiting sense.

We claim:

1. An integrated alarm and access control system for a building having at least one door, the system comprising in combination:

an access control package;

an intrusion detection package;

an interface unit operatively connected to the access control package and the intrusion detection package;

a position sensor connected to the interface unit for determining if the at least one door is opened or closed; and a locking device operatively connected to the interface unit for locking the at least one door in its closed position, whereby the interface unit can transmit status information from the position sensor to either the access control package or the intrusion detection package or both and can control the locking device responsive to the access control package.

2. An integrated alarm and access control system according to claim 1 further comprising:

an egress device for allowing the at least one door to be opened from one direction; and an alarm panel for indicating to a user if an alarm situation exists, and wherein the interface unit comprises in combination:

a supervisory circuit operatively connected to the position sensor for providing line security wherein the alarm panel is responsive to the supervisory circuit;

a door position relay operatively connected to the position sensor; and a first timer for determining a first predetermined time period, responsive to both the door position relay and the egress device, whereby the first timer inhibits an alarm panel response to the supervisory circuit even when the at least one door is open if the egress device is actuated, until the first predetermined time period has elapsed.

3. An integrated alarm and access control system according to claim 2 further comprising a prealarm indicator to give warning of a pending alarm condition, wherein the interface unit further comprises in combination:

a door control relay for operating the locking device, responsive to the access control package, and a second timer for determining a second predetermined time period, responsive to the door control relay, the egress device and the door position relay whereby the prealarm indicator gives a warning of a pending alarm condition responsive to the second timer when the at least one door is open and the second predetermined time period has elapsed, and whereby the access control package comprises a door position report circuit responsive to the door position relay, the first timer and the second timer for indicating to the access control package when the at least one door is open and either the first time period or the second time period has elapsed.

4. An integrated alarm and access control system according to claim 3, wherein the locking device is a fail-safe locking device, and wherein the interface unit further comprises:

an AC full unlock circuit operatively connected to the fail-safe locking device for unlocking the fail-safe locking device in the event of a power failure; and an emergency unlock circuit operatively connected to the fail-safe locking device for unlocking the fail-safe locking device in the event of loss of signal from the system.

5. In an integrated alarm and access control system for a building having at least one door equipped with a position sensor, an egress device and a locking device, an interface unit comprising in combination:

a supervisory circuit operatively connected to the position sensor for providing a line security alarm indication;

a door position relay operatively connected to the position sensor; and a first timer responsive to both the door position relay and the egress device for determining a first predetermined time period whereby the first timer inhibits an alarm indication by the supervisory circuit even when the at least one door is open if the egress device is actuated, until the first predetermined timer period has elapsed.

6. An interface unit according to claim 5 for an integrated alarm and access control system further having means for generating a door control signal , further comprising in combination:

a door control relay responsive to the means for generating a door control signal for operating the locking device, and a second timer responsive to the door control relay for determining a second predetermined time period, the egress device and the door position relay whereby the second timer indicates a prealarm condition when the at least one door is open and the second predetermined time period has elapsed, and whereby the door position relay, the first timer and the second timer indicate to the access control portion of the system when the at least one door is open and either the first time period or the second time period has elapsed.

7. An interface unit according to claim 5, wherein the locking device is a fail-safe locking device, and wherein the interface unit further comprises:

an AC fail unlock circuit operatively connected to the fail-safe locking device for unlocking the fail-safe locking device in the event of a power failure; and an emergency unlock circuit operatively connected to the fail-safe locking device for unlocking the fail-safe locking device in the event of loss of signal from the system.

* * * * *